US010358269B2

(12) United States Patent
Cerveny

(10) Patent No.: US 10,358,269 B2
(45) Date of Patent: Jul. 23, 2019

(54) HINGED CLOSURE FOR A CONTAINER

(71) Applicant: NESTEC S.A., Vevey (CH)

(72) Inventor: Jean-Paul Cerveny, Vittel (FR)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 15/746,239

(22) PCT Filed: Jul. 21, 2016

(86) PCT No.: PCT/EP2016/067454

§ 371 (c)(1),
(2) Date: Jan. 19, 2018

(87) PCT Pub. No.: WO2017/013226

PCT Pub. Date: Jan. 26, 2017

(65) Prior Publication Data

US 2018/0215515 A1 Aug. 2, 2018

(30) Foreign Application Priority Data

Jul. 22, 2015 (EP) ..... 15177905

(51) Int. Cl.
*B65D 47/08* (2006.01)

(52) U.S. Cl.
CPC ..... *B65D 47/0842* (2013.01); *B65D 47/0809* (2013.01)

(58) Field of Classification Search
CPC .... B65D 47/127; B65D 47/14; B65D 47/128; B65D 47/123; B65D 47/0842;
(Continued)

(56) References Cited

U.S. PATENT DOCUMENTS 2,687,157 A * 8/1954 Cowan ..... B29C 33/30 16/385
3,596,822 A * 8/1971 Holley ..... B65D 43/162 206/303

(Continued)

FOREIGN PATENT DOCUMENTS

CN 1144514 A 3/1997
EP 0631942 1/1995

(Continued)

OTHER PUBLICATIONS

Chinese Patent Office Communication for corresponding application No. 201680042013.2 dated Feb. 2, 2019, 10 pages.

*Primary Examiner* — Robert J Hicks
(74) *Attorney, Agent, or Firm* — K&L Gates LLP

(57) ABSTRACT

A closure for a container comprises a base and a cap comprising a top member and a body member; and a connecting member extending between and connecting the base and the cap, the cap being mobile between a first, closed position and a second, opened position, the body member further comprising a recess in the body member where the connecting member is fastened along a first hinge to the recess at a side thereof proximate to the top member, such that when the cap is disposed in the first, closed position the connecting member lies within the recess substantially flush with an exterior surface of the body member; the connecting member being capable of rotating through at least 90° about the first hinge in which the connecting member comprises a plurality of intermediate hinges providing rotation of the connecting member over a deflection of at least 270°.

13 Claims, 1 Drawing Sheet

(58) Field of Classification Search
CPC ..... B65D 47/0838; B65D 47/0833; B65D 47/0828; B65D 47/0823; B65D 47/0804; B65D 47/0809; B65D 47/08; B65D 47/06; B65D 55/16; B65D 1/0246; B65D 1/023; B65D 1/0223; B65D 43/162; B65D 43/16; B65D 43/169; B65D 51/18; B65D 25/48; B65D 25/40; B65D 83/28
USPC ..... 215/306, 243, 237, 235; 220/375, 837, 220/838, 836, 810, 254.3, 254.1, 259.1, 220/256.1; 222/568, 567, 566, 562, 532, 222/531, 529, 528
See application file for complete search history.

(56) References Cited

U.S. PATENT DOCUMENTS 4,896,787 A * 1/1990 Delamour ..... B65D 1/225 220/6
5,148,912 A * 9/1992 Nozawa ..... B65D 47/0809 215/235
5,501,348 A * 3/1996 Takeuchi ..... B65D 47/0809 215/235
5,769,253 A * 6/1998 Gross ..... B65D 47/0814 215/235
6,321,923 B1 * 11/2001 Wood ..... B65D 47/0809 16/225
6,419,101 B1 7/2002 Hessel et al.
2006/0076309 A1 * 4/2006 Delman ..... A61J 9/00 215/306
2009/0026166 A1 1/2009 Druitt
2010/0005641 A1 1/2010 Druitt et al.
2014/0197189 A1 7/2014 Lagler

FOREIGN PATENT DOCUMENTS

EP 2532602 A1 * 12/2012 ..... B65D 47/08
GB 2499441 A * 8/2013 ..... B65D 41/0485
NL 109857 6/1964

* cited by examiner

HINGED CLOSURE FOR A CONTAINER

CROSS REFERENCE TO RELATED APPLICATIONS

The present application is a National Stage of International Application No. PCT/EP2016/067454, filed on Jul. 21, 2016, which claims priority to European Patent Application No. 15177905.5, filed on Jul. 22, 2015, the entire contents of which are being incorporated herein by reference.

FIELD OF THE INVENTION

The present invention concerns a hinged closure for a container, as well as a container comprising such a closure.

BACKGROUND OF THE INVENTION

In the container-fabrication art, it is desirable to provide containers with closures which can be easily opened and closed with one's bare hands, without necessitating the use of tools such as bottle openers or corkscrews. To this end, numerous different closures have been proposed.

One type of closure that is of particular interest is the so-called "flip-cap" closure (also commonly known as a "sport cap" closure), which comprises a cap attached to a base disposed on a mouth of the container by a hinge. When the closure is opened, the cap rotates about an axis of the hinge situated substantially tangent to a rim of the base, and swings upward and away from the mouth of the container.

Such flip-cap closures are particularly advantageous in that they require no tools to open and are generally easy to use by those possessing minimal dexterity or grip strength without sacrificing sealing performance. Moreover, the hinge structure ensures that the cap remains retained with the container at all times, thereby reducing the risk of choking and minimizing the proliferation of litter.

With regard to flip-cap closures, it is particularly desirable in to provide a flip-cap closure which presents as little obstruction as possible to the dispensing and/or consumption of the product held within the container. Specifically, it is desirable to provide a flip-cap closure configured such that, when fully opened, the cap of the closure is as far removed from the opening of the closure as possible, so as to prevent contact between the cap and the face of the consumer when the latter is drinking directly from the container. Moreover, to maximize ease of use, the cap should open in a smooth and predictable manner.

To this end, there exist in the prior art attempts to maximize the range of motion in a flip-cap closure. In particular, it has long been known in the art to provide a hinge in the form of a long, freely-flexible strip of material, which connects the base of the closure to the cap at a point at or near the top of the cap. While this can achieve a great deal of deflection, this is disadvantageous in that a large portion of the hinge protrudes when the closure is disposed in the closed position.

Other closures exist which minimize the amount by which the hinge protrudes from the closure when closed. In particular, the document WO 99/64312 A1 (WO'312) describes a flip-cap closure with a connecting member. In WO'312, the connecting member consists of a cap connected to a base by means of two hinges connected in series. When the cap is disposed on the base to seal the closure, the protrusion of the hinge from the cap is minimal.

However, the structure of the hinge and the cap substantially block any further rotation, limiting the range of motion of the closure. However, the closure of WO'312 can still come into contact with the face of the user as he or she drinks from the container, because even at a full 180° deflection, the cap of WO'312 is no further away from the end of the container than when it is in the fully-closed position. The closure of WO'312 is insufficient to resolve the problems known in the art.

There is thus a need for a flip-cap type closure wherein the protrusion of the hinge in the closed position is minimized, but also in which the cap can be opened to a high degree of deflection.

SUMMARY OF THE INVENTION

According, therefore, to a first aspect, there is provided a closure for a container, comprising a base configured to be attached to a mouth of said container; a cap comprising a top member and a body member extending from said top member; and a connecting member comprising a strip of resilient material extending between and connecting said base and said cap, said cap being mobile between a first, closed position wherein said cap is disposed upon said base, and a second opened position wherein said cap is detached from said base.

According to said first aspect, said body member comprises a recess with a first side opening on an edge of said body member opposite the top member, and said connecting member is fastened along a first hinge to a second side of the recess opposite said first side, such that when said cap is disposed in said first, closed position, said connecting member is accommodated in said recess such that it lies substantially flush with an exterior surface of said body member; and when said cap is disposed in said second, open position, said connecting member is rotated through at least 90° about said first hinge. According to the invention, the connecting member comprises a plurality of intermediate hinge providing rotation of said connecting member over a deflection of at least 270°.

This is advantageous in that, when the closure is disposed in the first, closed position, the connecting member will lie within the recess such that it is flush with the body member of the cap. Thus, there is no structure projecting from the cap.

Simultaneously, the provision of the flexible connecting member with the hinge at its connection with the base and provision of the flexible connecting member comprising a plurality intermediate hinge, will result in a maximal deflection of the cap. As the connecting member will join with the cap at an edge opposed to its mouth (i.e. proximate to its top end), the combined deflection of the first hinge and of the connecting member itself will provide sufficient deflection of the cap to permit it to be moved away from the mouth of a container upon which the closure is disposed.

In this way, a closure is achieved which is both flush with the cap in the second, opened position, and deflected away from the face of the user when in the first, closed position. The advantages of the different prior art closures are realized, without suffering their disadvantages.

Preferably, the second side of the recess is closer to the top member than to the first side of said recess.

This is advantageous in that it will increase the possible length of the connecting member, maximizing the deflection of the cap when disposed in the second, opened position.

In a preferred embodiment, said connecting member is fastened along a second hinge to said base, such that when said cap is disposed in said second, opened position, said connecting member is rotated through at least 90° about said second hinge.

This is advantageous in that, as the second hinge is disposed at the interface between the connecting member and the base, the cap will be displaced away from the end of the closure base and the user's face, towards the opposite end of the bottle. In this way, the comfort and ease of use of a container comprising the closure is maximized.

As previously mentioned, said connecting member comprises a plurality of intermediate hinges. Such an arrangement yields a maximum degree of deflection in the closure incorporating it. In particular, the greater the number of intermediate hinges, the greater the articulation of the connecting member and the greater the deflection of the cap relative to the base.

Preferably, the plurality of hinges is configured in progressively increasing rigidity from the cap to the base.

This is advantageous in that when the connecting member is fully deflected and the closure fully opened, the cap will be displaced towards the base of the container, past the level of its mouth. In this way, the cap is placed at a greater distance from the mouth of the container, and by extension the face of the user, than the closures known in the art.

In a preferred embodiment, the recess in the body member of the cap comprises a notch.

In this way, the connecting member is made to lie flush with the surface of the cap in a way that is easy and inexpensive to implement.

In a possible embodiment, at least one of the hinges is formed by a localized reduction in the thickness of the connecting member.

This is advantageous in that, by providing such a localized reduction in thickness, the stiffness of the hinges can be controlled with a reasonably-high degree of precision, and with a minimal degree difficulty or added cost of fabrication.

Preferably, at each of the hinges the resilient member has a thickness of between 0.15 and 0.30 millimeters.

This is advantageous in that such hinges will in many implementations have an optimal balance between stiffness, smoothness of operation, durability, and ease of fabrication.

Most preferably, at least one of the hinges is a butterfly hinge.

This is advantageous because butterfly hinges are durable, easy to fabricate, and provide a large range of motion with a smooth action.

In a possible embodiment, said at least one butterfly hinge has a vertex angle between 15° and 20°

This is advantageous in that, as the stiffness of a hinge is partially dependent on the vertex angle, the hinges so configured will have an optimal balance between stiffness, durability, and ease & smoothness of operation.

In a possible embodiment, the connecting member is bistably mobile between the first, closed position and the second, opened position.

This is advantageous in that when the closure is opened, the user does not need to hold the cap away from the mouth of the container. Likewise, the bistable nature of the connecting member will bias the cap against the base once the closure has been closed, preventing inadvertent opening of the closure and facilitating its operation by the user. In this way, the usability of the closure is greatly improved.

In a possible embodiment, the closure is fabricated from poly-ethylene terephthalate, low- or high-density polyethylene, polypropylene, or vinyl resin.

This is advantageous in that a food-grade closure can be fabricated at a minimal cost and with a great deal of precision using conventional injection-moulding processes. Moreover, such materials are advantageous in that they have a high degree of resistance to fatigue; a connecting member fabricated therefrom will have a long service life.

In a preferable embodiment, the connecting member is formed integrally with the base and cap.

In this way, the entire closure is fabricated in a single, easily-manipulable piece, thereby facilitating its use in a container fabrication and filling operation.

According to a second aspect, the invention is drawn towards a container provided a closure as described above.

In this way, the advantages of the closure described above are realized in a container, ready for sale and use.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
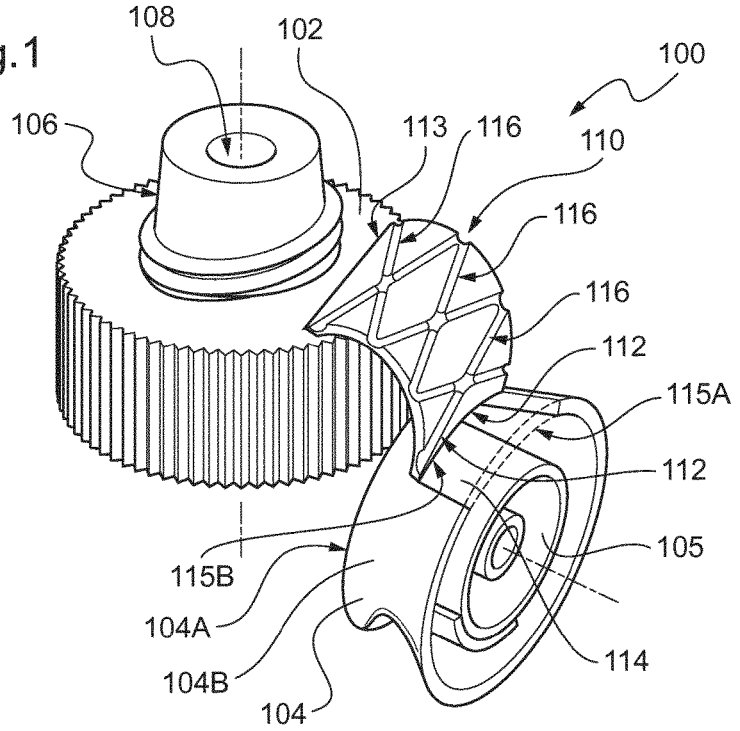
FIG. 1 is a partial perspective view of a closure according to the invention.

FIG. 1 illustrates an exemplary closure 100 according to the invention. The closure 100 comprises a base 102 and a cap 104 configured to be disposed on the base 102. The base 102, in its turn, is configured to be attached to the mouth of a container, according to the fashion generally known in the art.

The base 102 is a substantially cylindrical, hollow structure, configured to fit on and about a mouth of a container (not shown). To this end, it may be provided with internal screw threads, locking beads, or other such structures as necessary to attach the base 102 to the container and seal it therewith.

The cap 104 is also a hollow, substantially cylindrical structure, generally based on a top member 104A, which is generally a flat or convex member which, when the cap 104 is disposed upon the base 102, is disposed generally parallel with the mouth of the container.

The cap 104 further comprises a body member 104B. The body member 104B is, here, a substantially cylindrical wall, which extends from the perimeter of the top member 104A.

In this embodiment, the base 102 here comprises a spout 106, which is furnished with a nozzle 108. The nozzle 108 is in fluid communication with the inside of a container (not pictured) upon which the closure 100 is disposed; in this way, the product can be dispensed into another recipient (e.g. a cup), or the user may simply place his or her mouth on the spout 106 and drink directly from the container.

Thus, when the cap 104 is placed upon the base 102 in a first, closed position, the cap seals the nozzle 108 of the spout 106, ensuring that the container does not leak or spill while being manipulated or transported.

Optionally, the cap may be furnished with a sealing structure, here represented by the sealing ring 105 disposed within the cap. The sealing ring 105 will engage with the nozzle 108 and spout 106, further improving the sealing action of the closure 100.

The closure is further provided with a connecting member 110, in the form of a strip of resilient material extending from the base 102 to the cap 104.

The connecting member 110 comprises a first hinge 112 and a second hinge 113.

The first hinge 112 is situated at the interface of the connecting member 110 and the cap 104, while the second hinge is disposed at the interface between the connecting member 110 and the base 102. Since the connecting member 110 is ideally fabricated from a flexible, resilient material, the combined action of the connecting member 110 and the first and second hinges 112, 113 will permit the deflection of the cap 104 between the first, closed position and a second, opened position wherein the cap 104 is detached from said base 102.

The cap 104 is moreover provided with a recess 114, which is, in the present embodiment of the invention, comprises a notch in the body member 104B. Said recess 114 is substantially the same width as the connecting member 110 and defined by a first edge 115A and a second edge 115B. The first edge 115A is defined essentially by the body member 104B, as depicted here. The second edge 115B is parallel to the top member 104A of the cap 104, and disposed such that it is closer to said top member 104A than it is to the second edge 115B.

It is most preferable that the height of the recess 114, i.e. the distance between the first edge 115A and the second edge 115B, be greater than half of the total height of the cap 104. This will permit the connecting member 110 to be long enough to rotate the cap 104 down and away from the nozzle 108 without binding on the base 102. Therefore, the second edge 115B is disposed closer to the top member 104A than it is to the first edge 115A, in order to realize the full benefit of the invention.

The first hinge 112 thus connects the cap 104 to the connecting member 110 at the second edge 115B, permitting the cap 104 to rotate through at least 90° about the second edge 115B. In the same way, the second hinge 113 permits the cap 104 to rotate through at least 90° about the joint between the connecting member 110 and the base 102. Finally, since the connecting member 110 is a flexible, resilient strip of material, it is itself deflectable so as to rotate the cap 104 another 90°.

The collective effect of this is to rotate the cap 104 through at least 270° when it is moved from the first, closed position to the second, opened position. Moreover, the length of the connecting member 110 will displace the cap 104 away from the nozzle 108, reducing the likelihood that the cap 104 will contact the face of a user drinking from the container to which the closure 100 is attached.

The recess 114 accommodates the connecting member 110 when the cap is disposed in the first, closed position. In this way, the connecting member 110 will be disposed flush with the body member 104B of the cap, avoiding any protrusion of the connecting member.

In the present embodiment, the recess 114 is furnished in the form of a notch in the body member 104B. However, other forms for the recess are certainly possible. In particular, it may be advantageous to furnish the recess 114 in the form of a concavity, so as to avoid having any openings in the body member 104B through which dirt or other contaminants may enter.

It will be recognized that, insofar as the flexion of the connecting member 110 is concerned, a sufficient deflection may be achieved simply by way of the elastic properties of the connecting member 110. However, in many embodiments, it may be advantageous to provide a certain structure within the connecting member 110 so as to ensure that this deflection occurs in a controlled manner, and to minimize wear on the connecting member.

To this end, the connecting member 110 is provided with several intermediate hinges 116. The intermediate hinges 116 are so-called butterfly hinges, which are constituted by the live hinges formed in the connecting member 110 in the X-shaped arrangements depicted in FIG. 1. Such live hinges are merely localized, profiled reductions in the thickness of the connecting member 110, and may thus be furnished in a simple and inexpensive fashion. Said plurality of intermediate hinge allows providing rotation of said connecting member over a deflection of at least 270° which is an important advantage versus prior art.

Thus, the stiffness of each hinge 112, 116 is thus at least partially a function of the thickness of the connecting member 110 at that location: the thicker the remaining material at the hinge 112, 116, the stiffer the hinge will be.

In a preferred embodiment the thickness of the hinges 112, 116 varies from between 0.15 and 0.30 millimeters, which has been found offer an acceptable compromise between smooth operation and durability in the connecting member 110.

It will be noted that the butterfly hinges that constitute each of the intermediate hinges 116 are formed in a pair of V-shaped structures, with each of them having a vertex angle θ (one of which is depicted here for clarity). All else being equal, the shallower the vertex angle θ formed in one of intermediate hinges 116, the more supple that intermediate hinge 116 will be when the connecting member 110 is deflected. In the embodiment depicted here the angle e is between 15° and 20°; however, this may be varied as appropriate to the particular embodiment of the invention.

It will therefore be readily understood that by controlling the stiffness of each of the first and second hinges 112, 113 and the intermediate hinges 116 as heretofore described, one can realize a great deal of control over the motion of the cap 104 as it is displaced from the first, closed position to the second, opened position. In particular, the curvature of the form assumed by the connecting member 110 when the cap 104 is disposed in the second, opened, position can be substantially pre-determined by carefully selecting the stiffness of said hinges 112, 113, 116.

In the embodiment depicted in FIG. 1, for instance, the first and second hinges 112, 113 and the intermediate hinges 116 are configured such that the second hinge 113 (disposed where the connecting member 110 meets the base 102) is the most rigid, and the intermediate hinges 116 decrease in stiffness progressing from the base 102 to the cap 104, with the first hinge 112 (disposed where the connecting member 110 meets the cap 104) being the most flexible. In this way, the position of the cap 104 when it is disposed in a fully-opened position, where the connecting member 110 is fully extended, is effectively controlled. This aspect is discussed in further detail below with reference to FIGS. 2 and 3.

Of course, it will be understood that the stiffness gradient of the hinges may differ from that presented in the present embodiments, for instance decreasing in stiffness from the cap to the base, or with the intermediate hinges configured to be stiffer than either the first or second hinges.

Ideally, the connecting member 110 is configured such that it is bistable; that is, naturally disposed to be in one of two stable positions. Said stable positions will, ideally, correspond to the first, closed position and the second, opened position. While the provision of the intermediate hinges 116 in the form of butterfly hinges will provide a degree of bistability, this bistability may also be provided by e.g. creating a degree of curvature across the width of the connecting member 110, or by any other means as appropriate.

Furthermore, while the connecting member 110 may be provided as a discrete, separately-fabricated component, in many implementations it may be preferable to fabricate the base 102, cap 104, and connecting member 110 as a single, discrete component. Such a fabrication may easily be accomplished by way of known techniques, such as injection moulding and the like.

The closure 100 will thus be easily manipulated and assembled to a container in a container-fabrication process. The closure 100 may be fabricated from a number of different materials; however, for most uses a moulded polymer resin is desirable. In particular, resins such as polyethylene terephthalate, low- or high-density polyethylene, polypropylene, and vinyl are advantageous, in that they all have desirable fatigue resistance properties and are well-known in the plastic fabrication arts. Such resins are also advantageous in that they can be furnished in food-grade quality, making the resulting closures ideally suited for containers intended for foods and/or beverages.

Figure 2:
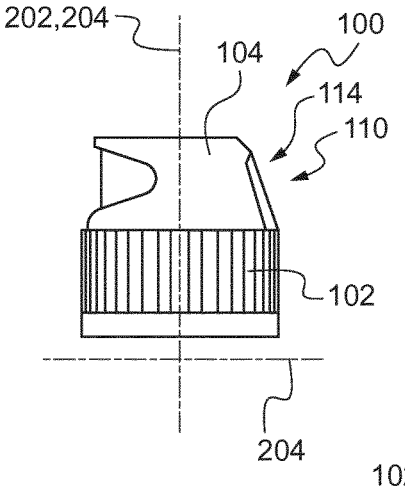
FIGS. 2 and 3 are side views of the closure of FIG. 1 in a fully-closed and fully-opened disposition, respectively.
Figure 3:
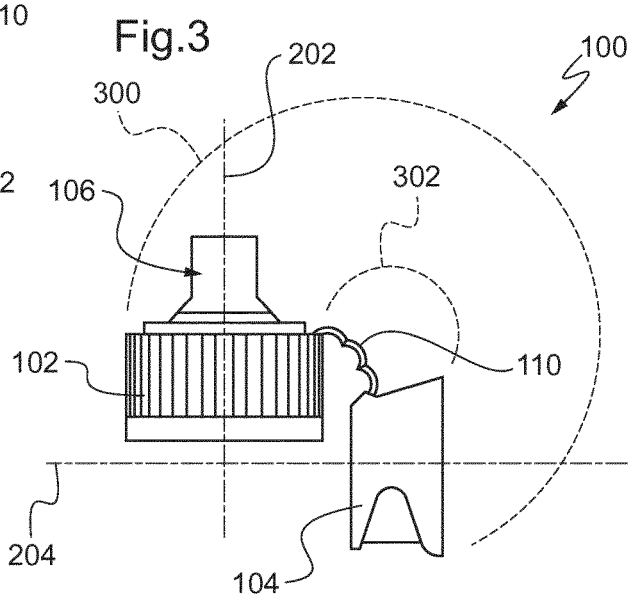

Turning now to FIGS. 2 and 3, the operation of the closure 100 is now discussed.

In FIG. 2, the closure 100 is depicted in a closed position, with the cap 104 disposed on the base 102. The base 102 has an associated axis 202, about which it is generally symmetric; the cap 104 also has an associated axis 204, about which it is also generally symmetric. As the cap 104 is disposed upon the base 102, the axes 202, 204 are generally coincident.

It is recalled that the connecting member 110 is configured such that the closure 100 is bistable between an open and a closed position. Thus, when the cap 104 is disposed upon the base 102 to put the closure 100 in the closed position depicted in FIG. 2, the rigidity of the connecting member 110 will serve to bias the cap into a closed position.

In this way, the sealing action of the closure 100 is augmented, and a small margin of protection against the inadvertent dislodging of the cap 104 is provided.

It will also be evident that the connecting member 110 is disposed in the recess 114, and thus lying flush with the surface of the cap 104. In this way, the closure 100 avoids any protrusions when disposed in the first, closed position.

FIG. 3 depicts the closure 100 in an opened position, with the cap 104 displaced into the position shown.

In particular, an exemplary motion of the cap 104 is indicated by the dashed lines 300, 302. Specifically, the cap first translates upwardly away from the base 102, so as to clear the spout 106. The cap subsequently translates laterally and vertically into a position aside the base 102 shown here, and rotates through approximately 270° of rotation.

As mentioned above, the opened position depicted in FIG. 3 constitutes the other stable position of the bistable connecting member 110. More specifically, the rigidity of the connecting member 110 will maintain the cap 104 in the opened position and prevent it from contacting the face of the user, or otherwise impeding the use of the container of which the closure 100 is a part.

The displacement of the cap 104 is particularly evident when considering the position of the axis 204 of the cap 104, relative to the base 102 and its axis 202. The position of the axis 204 shows that the cap 104 has been displaced downwards, further away from the nozzle disposed at the end of the spout 106 and, by extension, further from the face of the user.

However, as discussed above the motion of a cap as it moves from the closed position to the opened position is primarily a function of the configuration of the connecting member. Thus, it will be understood that in any particular embodiment, the motion of the cap specifically, the translation and rotation of said cap at any point in its movement from the closed to the opened position can be substantially pre-determined in part based on the configuration of the connecting member.

In particular, it will be readily understood that the number of intermediate hinges formed in the connecting member need not necessarily be the same as in the embodiment disclosed above. Rather, the number of said intermediate hinges may be adapted so as to achieve the degree of motion necessary for the application to which that particular embodiment is adapted.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A closure for a container, comprising:

a base configured to be attached to a mouth of the container;

a cap comprising a top member and a body member extending from the top member; and a connecting member comprising a strip of resilient material extending between and connecting the base and the cap, said the cap being mobile between a first, closed position wherein the cap is disposed upon the base, and a second, opened position wherein the cap is detached from the base, in which the body member comprises a recess with a first side opening on an edge of the body member opposite the top member, and the connecting member is fastened along a first hinge to a second side of the recess opposite the first side, and in which when the cap is disposed in the first, closed position, the connecting member is accommodated in the recess such that the connecting member lies substantially flush with an exterior surface of the body member; and when the cap is disposed in the second, opened position, the connecting member is rotated through at least 90° about the first hinge;

the connecting member comprises a plurality of intermediate hinges providing rotation of the connecting member over a deflection of at least 270°; and the plurality of intermediate hinges are configured in progressively increasing rigidity from the cap to the base.

2. The closure according to claim 1, wherein the second side of the recess is closer to the top member than to the first side of the recess.

3. The closure according to claim 1, wherein the connecting member is fastened along a second hinge to the base, such that when the cap is disposed in the second, opened position, the connecting member is rotated through at least 90° about the second hinge.

4. The closure according to claim 3, wherein the hinges are configured such that the second hinge is the most rigid, the intermediate hinges decrease in rigidity progressing from the base to the cap, and the first hinge is the least rigid.

5. The closure according to claim 1, wherein the recess in the body member of the cap comprises a notch.

6. The closure according to claim 1, wherein at least one of the hinges is formed by a localized reduction in the thickness of the connecting member.

7. The closure according to claim 6, wherein at each of the hinges the strip of resilient material has a thickness of between 0.15 and 0.30 millimeters.

8. The closure according to claim 1, wherein at least one of the hinges is a butterfly hinge.

9. The closure according to claim 8, wherein the at least one butterfly hinge has a vertex angle between 15° and 20°.

10. The closure according to claim 1, wherein the connecting member is bistably mobile between the first, closed position and the second, opened position.

11. The closure according to claim 1, wherein the closure is fabricated from a component selected from the group consisting of poly-ethylene terephthalate, low- or high-density polyethylene, polypropylene, and vinyl resin.

12. The closure according to claim 1, wherein the connecting member is formed integrally with the base and the cap.

13. A container comprising a closure comprising a base configured to be attached to a mouth of the container, a cap comprising a top member and a body member extending from the top member, and a connecting member comprising a strip of resilient material extending between and connecting the base and the cap, the cap being mobile between a first, closed position wherein the cap is disposed upon the base, and a second, opened position wherein the cap is detached from the base, in which the body member comprises a recess with a first side opening on an edge of the body member opposite the top member, and the connecting member is fastened along a first hinge to a second side of the recess opposite the first side, and in which when the cap is disposed in the first, closed position, the connecting member is accommodated in the recess such that the connecting member lies substantially flush with an exterior surface of the body member; and when the cap is disposed in the second, opened position, the connecting member is rotated through at least 90° about the first hinge, the connecting member comprises a plurality of intermediate hinges providing rotation of the connecting member over a deflection of at least 270°, and the plurality of intermediate hinges are configured in progressively increasing rigidity from the cap to the base.

* * * * *